United States Patent [19]

Duc

[11] 4,173,804

[45] Nov. 13, 1979

[54] FLOATING INSTALLATION CONNECTED TO A STATIONARY UNDERWATER INSTALLATION THROUGH AT LEAST ONE FLEXIBLE PIPE

[75] Inventor: Xuong N. Duc, Malmaison, France

[73] Assignee: Institut Francais du Petrole, Malmaison, France

[21] Appl. No.: 875,792

[22] Filed: Feb. 7, 1978

[30] Foreign Application Priority Data

Feb. 9, 1977 [FR] France ..... 77 03833

[51] Int. Cl.[2] ..... B63B 21/52

[52] U.S. Cl. ..... 9/8 P; 114/230; 114/264; 254/172

[58] Field of Search ..... 9/8 R, 8 P, 8.3 R, 8.3 E; 114/264, 265, 230, 263, 268, 270, 245, 293, 253; 254/172

[56] References Cited

U.S. PATENT DOCUMENTS

| | | | |
|---|---|---|---|
| 2,948,512 | 8/1960 | Crenshaw | 254/172 |
| 3,204,708 | 9/1965 | Berne | 9/8 R |
| 3,695,207 | 10/1972 | Atlas | 114/230 |

*Primary Examiner*—Jesus D. Sotelo

*Attorney, Agent, or Firm*—Craig and Antonelli

[57] ABSTRACT

The flexible pipe forms at least one loop portion between the two installations, an element of negative buoyancy being suspended from said loop portion and permanently maintaining the flexible pipe under tension.

15 Claims, 7 Drawing Figures

FLOATING INSTALLATION CONNECTED TO A STATIONARY UNDERWATER INSTALLATION THROUGH AT LEAST ONE FLEXIBLE PIPE

The present invention relates to a floating installation connected to a stationary underwater installation through at least one flexible pipe.

According to the invention, the flexible pipe is permanently maintained under a limited tensile stress, irrespective of the variations in the external forces applied to the surface installation by wind, heave, water currents etc.

The invention may, for example, but not exclusively, find applications in the oil field, more precisely whenever flexible pipes are used to convey a liquid and/or gaseous fluid between an underwater installation, such as a hydrocarbon production equipment resting on the water bottom, and a floating installation, such as a floating flare, or an offshore loading terminal for oil tankers.

Figure 1:
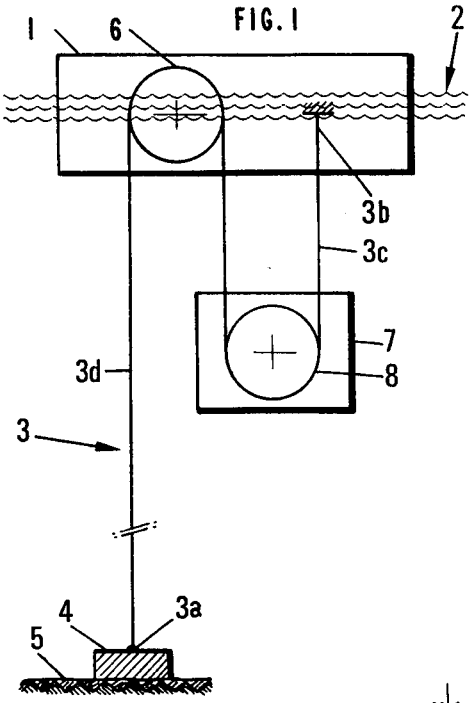
Figure 5:
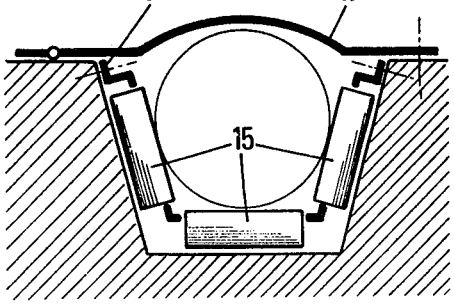
Figure 2:
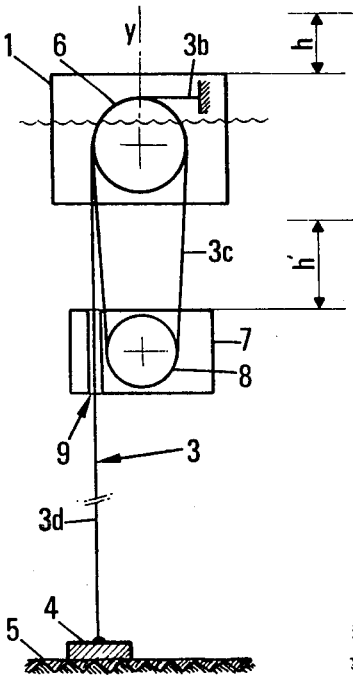
Figure 2A:
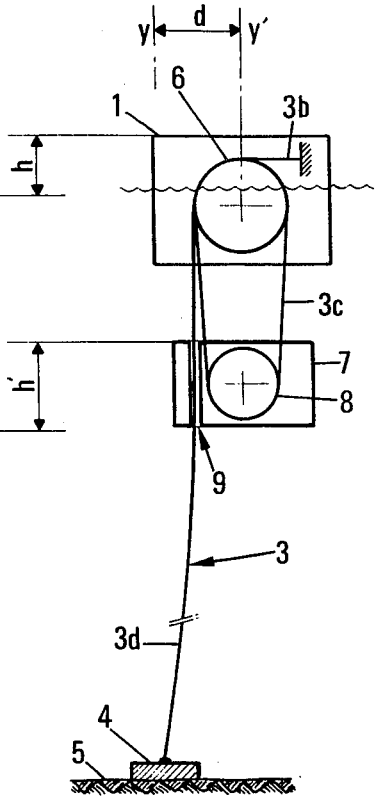
Figure 2B:
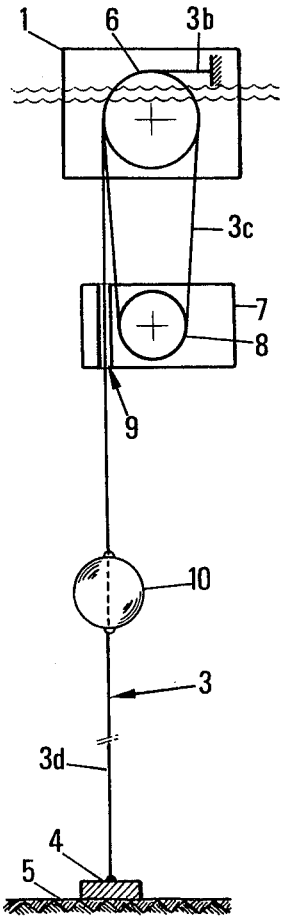
Figures 3, 4:
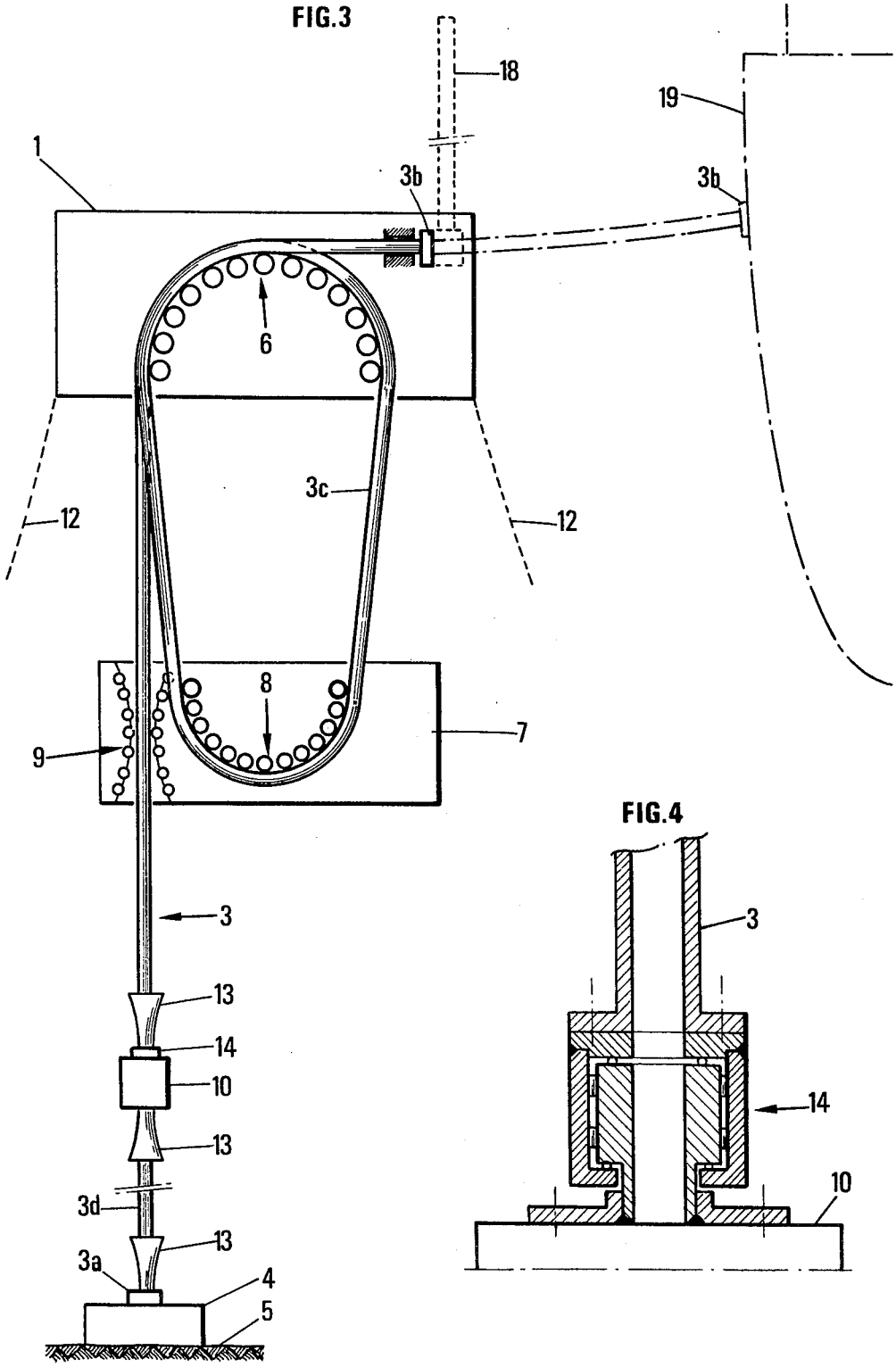

The invention will be readily understood and its advantages made apparent from the following description illustrated by the accompanying drawings wherein:

FIG. 1 diagrammatically shows a floating installation according to the invention, FIG. 2 shows a preferred alternative embodiment of this installation, FIG. 2A illustrates the operation of the invention, FIG. 2B shows another embodiment, FIG. 3 illustrates more in detail an embodiment of the invention suitable as floating flare or as loading terminal for a tanker, FIG. 4 diagrammatically shows a rotary coupling, and FIG. 5 is a detail of an embodiment of the direction reversing means illustrated in FIG. 3.

FIG. 1 diagrammatically illlustrates a floating installation according to the invention, comprising a buoyant element 1 floating at the water surface 2 and which may be used as floating flare or as offshore loading terminal for oil tankers.

This floating element is connected, through a flexible pipe 3, to an installation diagrammatically shown at 4, resting on the water bottom. This installation 4 is, for example, a gathering installation for an underwater oil field.

The lower end 3*a* of flexible pipe 3 is secured to installation 4 while the other end 3*b* of the pipe is secured to floating element 1. The pipe length 3 is substantially greater than the depth of the water body wherein the equipment is immersed.

According to the invention, the flexible pipe is permanently kept under tension by suitable means comprising a direction reversing member 6 secured to floating element 1, a heavy immersed element or ballast 7 whose apparent weight in water is positive (negative buoyancy) and which is provided with a direction reversing element 8. From installation 4, pipe 5 runs over direction reversing elements 6 and 8 respectively, these elements being of any suitable type such as pulleys, so that portion 3*c* of pipe 3 between the free end 3*b* and the direction reversing element 3 forms at least one loop portion.

Ballast 7 is suspended from floating member 1 through flexible pipe 3. Pipe 3 is permanently kept under tension through ballast 7, the value of this tension being roughly, in the absence of any external force which may for example result from wind, heave, or sea currents, substantially equal to one half of the apparent weight of ballast 7.

The embodiment of the invention illustrated by FIG. 1 may however suffer from some drawbacks due to the fact that, by successively passing over direction reversing elements 6 and 8, the curvature of pipe 3 is reversed, and that ballast 7 may, under some conditions, be subjected to a pendular movement. These two drawbacks can result in a permature wear of pipe 3. They are obviated with the modified embodiment of the invention diagrammatically shown in FIG. 2.

In this embodiment the curvature of portion 3*c* of pipe 3*a* has always the same direction and this pipe portion forms at least one substantially complete loop by successively passing on direction reversing means 6 and 8. Moreover ballast 7 is provided with guide means which cooperates with the portion of pipe 3 comprised between mooring 4 and direction reversing device 6 for substantially preventing any pendular movement of ballast 7 relative to pipe 3.

In the non-limitative embodiment illustrated by FIG. 2A, anchoring of buoyant member 9 is also achieved by a flexible pipe whose structure, which may be of a known type, is selected from those capable of withstanding high tensile stresses.

FIG. 2A illustrates the behaviour of the buoy when subject to external forces moving it vertically (pounding) or horizontally (drift). These external forces result, for example, of the action of wind, heave and/or water currents.

When these external forces are zero or small, the buoy is in its initial or reference location, indicated by axis Y in FIG. 2. The tension of pipe 3 has a value $T_0$ which this pipe can withstand without damage and which depends on the apparent weight of ballast 7 in water.

As long as the external forces applied to the buoy remain substantially small so that the variation $\Delta T$ in the tension of the flexible pipe does not reach a determined threshold value $\Delta T_1$ to which corresponds a substantial relative displacement between ballast 7 and floating element 1, the length of portion 3*c* of the pipe is not substantially modified, nor is the length of portion 3*d* between installation 4 and the direction reversing device 6. The buoy then remains very close to the reference position.

When the external forces applied to the buoy are such that the variation $\Delta T$ in the pipe tension reaches a threshold value $\Delta T_1$, a relative vertical displacement occurs between ballast 7 and floating element 1. This results in a variation in length of pipe portion 3*c* and 3*d*, which displaces the floating member 1 towards a new equilibrium position. This new equilibrium position is such that the difference between the tension in pipe 3 when the buoy is in the new equilibrium position and the tension in this pipe in the reference position has an absolute value lower than the threshold $\Delta T_1$.

When the external forces no longer act on the buoy 1, the latter, under the action of ballast 7, automatically comes back to a position which is very close to the reference position and wherein the tension in the pipe is substantially equal to $T_0$. In FIG. 2A the external forces have resulted in a drift of floating element 1 over a distance "d", and by the wave action this floating element has moved upwardly over a height "h". To compensate for the action of the external forces, the ballast has been vertically displaced over a height h'.

It is possible in practice to fix the value of threshold $\Delta T_1$ which depends in particular on the value of the tension $T_0$, of the pipe friction on the direction reversing elements, etc., so that the flexible pipe permanently remains under tension, or in other words $$T_0 \pm \Delta T_1 > 0$$

For small values of $\Delta T_1$ it is thus possible to assume that the pipe tension remains substantially constant.

Moreover, knowning the maximum value of the external forces which tend to produce a drift of the floating element 1, it is possible to select a ballast of sufficient apparent weight and optionally a sufficient cable length so that ballast 7 be prevented from abutting against floating element 1, should the tension variation in the pipe be kept at most equal to $\Delta T_1$. Moreover it may be of advantage to choose a pipe length sufficient to keep ballast 7 immersed at a depth where the swell action is either substantially equal to zero or at least greatly reduced. Obviously the structure of pipe 3 is to be selected in accordance with the forces which this pipe must withstand.

In some applications, for instance in the case of very long pipe porton 3*d*, it is possible to use an auxiliary immersed buoyant member 10 (FIG. 2B) connected to portion 3*d* of pipe 3 and exerting on the upper part of this pipe portion a tension at least equal to the maximum tension exerted in use on the remainder of the pipe.

This auxiliary buoyant member 10 is preferably immersed at a depth where the heave influence is small, this immersion depth being in any event greater than the maximum depth reached by ballast 7. One of the advantages resulting from the use of auxiliary buoyant member 10 is that it supports the whole weight of the lower part of pipe portion 3*d*, so that the size of floating element 1 can be reduced.

FIG. 3 shows more in detail an embodiment of the invention.

Anchoring of buoyant element 1 can be effected by flexible pipe 3 only or by anchoring cables 12 or both. Moreover guide members such as 13 are provided to limit bending of the flexible pipe at its ends respectively connected to intermediate buoyant member 10 and to underwater installation 4.

Connection of flexible pipe 3 to intermediate buoyant member 10 is preferably effected through a rotary coupling 14 to avoid any torsional effect which might result from a rotation of floating element 1 and ballast 7 about a vertical axis, under the action of vertical forces applied thereto.

FIG. 4 shows, by way of example, an embodiment of rotary coupling 14 but other types of rotary coupling may obviously be used.

In the embodiment illustrated by FIG. 3, direction reversing elements 6 and 8 have the shape of at least one groove whose bottom and side walls are limited by rollers 15 held in position through a holding plate 16, as diagrammatically illustrated by FIG. 5 which shows a cross-section of a groove.

A hinged safety strap 17 is optionally provided to maintain pipe 3 in the groove of the direction reversing element.

Similarly, guide member 9 may be formed by spherical elements or balls held in position by suitable plates.

Wearing is thus reduced to a minimum and does not induce in the flexible pipe high torsional stresses, when ballast 7 rotates relative to floating element 1, under the action of external forces.

When the installation according to the invention is used as a floating flare, the end 3*b* of flexible pipe 3 is connected through any suitable means to the flue 18 of the flare, this flue being shown in dotted line and being used for buring the gases. However, as indicated by a mixed line, the installation may be used as loading and unloading buoy or offshore terminal, the end 3*b* of flexible pipe being then adapted to be connected to an oil tanker 19.

Means for obturating the end 3*b* of the flexible pipe and means for connecting this end 3*b* to a floating tank may be provided, but have not been shown in the drawings for sake of clarity.

During transportation of the installation to its place of use, floating element 1 and ballast 7 may preferably be placed close to each other and interconnected through any known means.

What I claim is:

1. A floating installation comprising an element floating on the water surface, at least one flexible pipe having a first end secured to a point which is stationary with respect to the water bottom and having a second end secured to the floating element, the length of the flexible pipe being substantially greater than the distance of said stationary point from the water surface, automatic means maintaining said flexible pipe under substantially constant tension, irrespective of the external forces applied to the floating installation, said automatic tensioning means comprising a first direction reversing means carried by said floating element, an element of determined negative buoyancy corresponding to an apparent weight in water, a second direction reversing means carried by said element of negative buoyancy, said element of negative buoyancy being suspended from said floating element by means of flexible pipe which passes over said first and second direction reversing means forming at least one substantially full passing from one of said first and second direction reversing means to the other and back to said one of the direction reversing means with all curved portions of said flexible pipe having the same direction of curvature, so as to reduce wearing of said flexible pipe, before being secured to said floating element.

2. A floating installation according to claim 1, wherein said element of negative buoyancy is provided with at least one guide member cooperating with the flexible pipe for guiding said element of negative buoyancy during its displacement and substantially preventing pendular movement of said element of negative buoyancy.

3. A floating installation according to claim 1 or 2, comprising one auxiliary member of positive buoyancy secured to the flexible pipe at a determined depth for keeping the flexible pipe portion below said auxiliary member under a tension at least equal to the tension applied by said automatic tensioning means to said flexible pipe.

4. A floating installation according to claim 3, wherein the flexible pipe is connected to said auxiliary floating element, or to said stationary point, through at least one rotary coupling.

5. A floating installation according to claim 1, wherein said flexible pipe provides for the anchoring of said floating element.

6. A floating installation according to claim 1, wherein at said stationary point the flexible pipe is connected to a source of fluid and conveys this fluid from said source to said floating element.

7. A floating installation according to claim 6, wherein said source is a source of gas and said floating element is provided with a flue for discharging and burning the gas, said end of the flexible pipe secured to said buoyant element being in communication with said flue.

8. A floating installation according to claim 6, further comprising means for loading floating tanks formed by the end of the flexible pipe secured to said buoyant element being provided with means for obturating said pipe end and for connecting it to said floating tank.

9. A floating installation comprising an element floating on the water surface, at least one flexible pipe having a first end secured to a point which is stationary with respect to the water bottom and having a second end secured to the floating element, the length of the flexible pipe being substantially greater than the distance of said stationary point from the water surface, automatic means maintaining said flexible pipe under substantially constant tension, irrespective of the external forces applied to the floating installation, said automatic tensioning means comprising a first direction reversing means carried by said floating element, an element of determined negative buoyancy corresponding to an apparent weight in water, a second direction reversing means carried by said element of negative buoyancy, said element of negative buoyancy being suspended from said floating element by means of said flexible pipe which passes over said first and second direction reversing means forming at least a loop portion before being secured to said floating element, said element of negative buoyancy being provided with at least one guide member cooperating with the flexible pipe for guiding said element of negative buoyancy during its displacements, and one auxiliary member of positive buoyancy secured to the flexible pipe at a determined depth between said negative buoyancy element and the stationary point for keeping the flexible pipe portion below said auxiliary member under a tension at least equal to the tension applied by said automatic tensioning means to said flexible pipe.

10. A floating installation according to claim 9, wherein said flexible pipe provides for the anchoring of said floating element.

11. A floating installation according to claim 10, wherein at said stationary point the flexible pipe is connected to a source of fluid and conveys this fluid from said source to said floating element.

12. A floating installation according to claim 11, wherein said source is a source of gas and said floating element is provided with a flue for discharging and buring the gas, said end of the flexible pipe secured to said floating element being in communication with said flue.

13. A floating installation according to claim 11, further comprising means for loading floating tanks, formed by the end of the flexible pipe that is secured to said buoyant element being provided with means for obturating said pipe end and for connecting it to said floating tank.

14. A floating installation according to claim 9, wherein the flexible pipe is connected to said auxiliary floating element, or to said stationary point, through at least one rotary coupling.

15. A floating installation according to claims 2 or 9, wherein said guide member is formed at least in part by a passage through said element of negative buoyancy through which said flexible pipe passes.

* * * * *